US011095026B2

(12) United States Patent
Lee

(10) Patent No.: US 11,095,026 B2
(45) Date of Patent: Aug. 17, 2021

(54) COMMUNICATION DEVICE WITH EXTENDED GROUNDING STRUCTURE TO ENHANCE ANTENNA PERFORMANCE

(71) Applicants: SERNET (SUZHOU) TECHNOLOGIES CORPORATION, Jiangsu (CN); Sercomm Corporation, Taipei (TW)

(72) Inventor: Pei-Ju Lee, Taipei (TW)

(73) Assignees: SERNET (SUZHOU) TECHNOLOGIES CORPORATION, Jiangsu (CN); Sercomm Corporation, Taipei (TW)

( * ) Notice: Subject to any disclaimer, the term of this patent is extended or adjusted under 35 U.S.C. 154(b) by 0 days.

(21) Appl. No.: 16/548,805

(22) Filed: Aug. 22, 2019

(65) Prior Publication Data

US 2020/0251816 A1 Aug. 6, 2020

(30) Foreign Application Priority Data

Jan. 31, 2019 (CN) ..... CN201920172885.1

(51) Int. Cl.
*H01Q 1/48* (2006.01)
*H01Q 9/06* (2006.01)
*H01Q 1/44* (2006.01)

(52) U.S. Cl.
CPC ..... *H01Q 1/48* (2013.01); *H01Q 1/44* (2013.01); *H01Q 9/06* (2013.01)

(58) Field of Classification Search
CPC ..... H01Q 1/48; H01Q 1/44; H01Q 1/243; H01Q 9/06; H01Q 9/0421
See application file for complete search history.

(56) References Cited

U.S. PATENT DOCUMENTS

| | | | | |
|---|---|---|---|---|
| 9,774,078 | B2 | 9/2017 | Margon et al. | |
| 2003/0076272 | A1 | 4/2003 | Kurjenheimo et al. | |
| 2008/0079635 | A1* | 4/2008 | Rowell | H01Q 9/42 343/700 MS |
| 2008/0129632 | A1* | 6/2008 | Moon | H01Q 21/28 343/848 |
| 2008/0252538 | A1 | 10/2008 | Ying | |

(Continued)

FOREIGN PATENT DOCUMENTS

| | | |
|---|---|---|
| CN | 102714353 | 10/2012 |
| CN | 101821900 | 10/2014 |

*Primary Examiner* — Raymond R Chai
(74) *Attorney, Agent, or Firm* — JCIPRNET

(57) ABSTRACT

The disclosure provides a communication device including a ground plane, an antenna and an extended grounding structure. The ground plane has a first side and a second side opposite to each other. The antenna is disposed at the first side and has a first feeding end. The extended grounding structure is disposed at the second side and includes a connection portion and a symmetrical structure. The symmetrical structure is electrically connected to the ground plane via the connection portion, wherein the symmetrical structure is symmetrical along a symmetry axis, and an extension line of the symmetry axis passes through the first side and the second side. The disclosure can effectively prevent antenna efficiency from being degraded due to an insufficient size of the ground plane, so as to significantly enhance communication quality.

11 Claims, 9 Drawing Sheets

100

(56) References Cited

U.S. PATENT DOCUMENTS

| | | | | |
|---|---|---|---|---|
| 2011/0156970 | A1* | 6/2011 | Wong | H01Q 5/20 343/722 |
| 2011/0193752 | A1* | 8/2011 | Wang | H01Q 1/242 343/702 |
| 2013/0141291 | A1 | 6/2013 | Luan | |
| 2013/0271326 | A1* | 10/2013 | Shimasaki | H01Q 9/42 343/700 MS |
| 2014/0354505 | A1 | 12/2014 | Kwon | |
| 2015/0109182 | A1* | 4/2015 | Chen | H01Q 1/521 343/841 |
| 2015/0295312 | A1* | 10/2015 | Lee | H01Q 9/42 343/845 |
| 2016/0164168 | A1* | 6/2016 | Choi | H01Q 1/243 343/702 |
| 2016/0197403 | A1 | 7/2016 | Choi et al. | |
| 2017/0271751 | A1* | 9/2017 | Sharawi | H01Q 5/314 |
| 2018/0175490 | A1* | 6/2018 | Meng | H01Q 1/48 |
| 2019/0052292 | A1* | 2/2019 | Seo | H04B 1/0064 |
| 2020/0203848 | A1* | 6/2020 | Tarng | H01Q 9/045 |
| 2020/0259252 | A1* | 8/2020 | Anguera | H01Q 9/045 |
| 2020/0295441 | A1* | 9/2020 | Anguera Pros | H01Q 1/526 |

* cited by examiner

COMMUNICATION DEVICE WITH EXTENDED GROUNDING STRUCTURE TO ENHANCE ANTENNA PERFORMANCE

CROSS-REFERENCE TO RELATED APPLICATION

This application claims the priority benefit of China application serial no. 201920172885.1, filed on Jan. 31, 2019. The entirety of the above-mentioned patent application is hereby incorporated by reference herein and made a part of this specification.

BACKGROUND

Technical Field

The disclosure relates to a communication device and more particularly, to a communication device with extended grounding structure to enhance antenna performance.

Description of Related Art

Generally, a mobile electronic device is equipped with a wireless radio frequency signal transceiver module and its corresponding antenna structure, such that the mobile electronic device is provided with the capability of receiving/transmitting wireless radio frequency (RF) signals to meet demands for data transmission. The antenna structure on the mobile electronic device has to correspond to a bandwidth and characteristics required for receiving/transmitting the RF signals.

In order to achieve a miniaturized and compact appearance, a size of the mobile electronic device is usually restricted in many ways, such that the design of the mobile electronic device has to be changed to meet requirement of the size restriction. However, part of the design changes may likely affect the performance of the mobile electronic device. For example, a size of a circuit board in the mobile electronic device may be reduced due to a requirement of a product size, such that an issue of an insufficient size of a ground plane of the antenna may occur, which causes poor antenna efficiency and degraded communication quality.

SUMMARY

The disclosure provides a communication device capable of effectively preventing antenna efficiency from being poor due to an insufficient size of a ground plane, so as to significantly enhance communication quality.

The communication device of the disclosure includes a ground plane, an antenna and an extended grounding structure. The ground plane has a first side and a second side opposite to each other. The antenna is disposed at the first side and has a first feeding end. The extended grounding structure is disposed at the second side and includes a connection portion and a symmetrical structure. The symmetrical structure is electrically connected to the ground plane via the connection portion, wherein the symmetrical structure is symmetric about a symmetry axis, and an extension line of the symmetry axis passes through the first side and the second side.

To sum up, the extended grounding structure having the symmetrical structure and the antenna are disposed respectively at two opposite sides of the ground plane in the embodiments of the disclosure, thereby employing the extended grounding structure as an extended ground plane of the antenna to improve antenna matching characteristic, increasing the bandwidth and preventing the antenna efficiency from being poor due to the insufficient size of the ground plane, so as to significantly enhance communication quality.

To make the above features and advantages of the disclosure more comprehensible, embodiments accompanied with drawings are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF EMBODIMENTS

Figure 1:
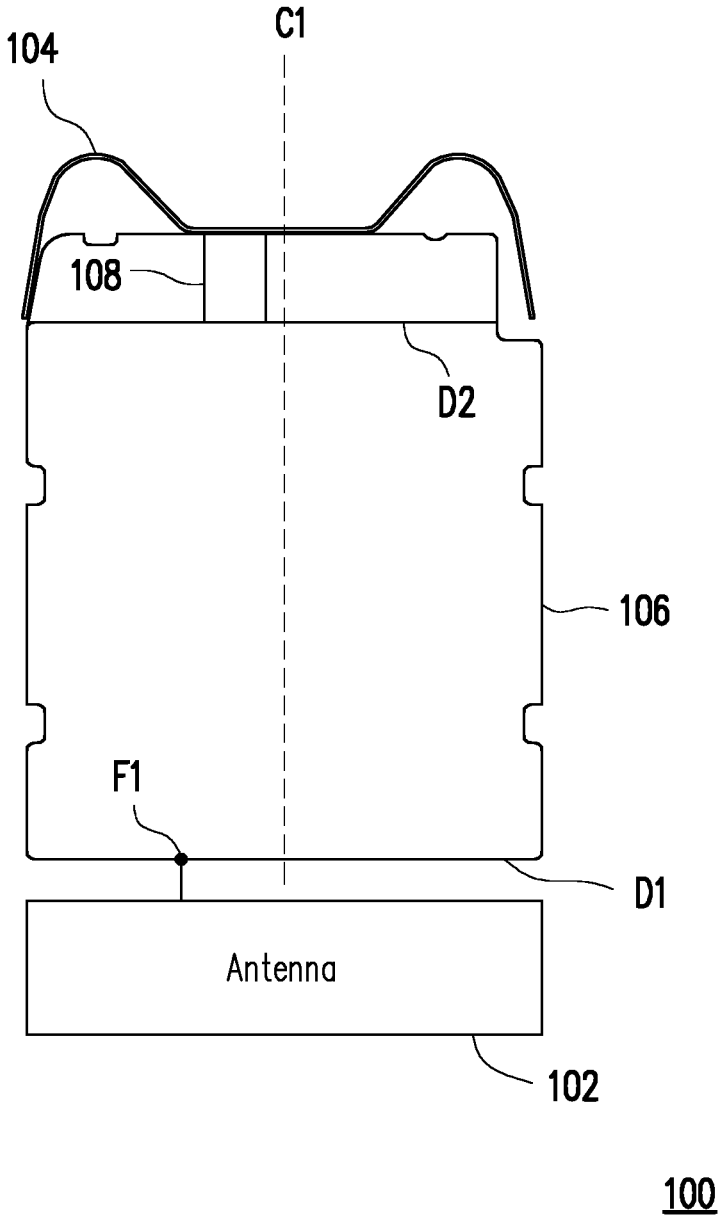
FIG. 1 is a schematic diagram illustrating a communication device according to an embodiment of the disclosure.

FIG. 1 is a schematic diagram illustrating a communication device according to an embodiment of the disclosure. Referring to FIG. 1, a communication device 100 may be, for example, a mobile phone or a tablet computer, or a user equipment (UE) defined in the 3rd Generation Partnership Project (3GPP) mobile communication standard. The communication device 100 includes an antenna 102, an extended grounding structure including a symmetrical structure 104 and a connection portion 108 and a ground plane 106. As illustrated in FIG. 1, the ground plane 106 includes a side D1 and a side D2, the antenna 102 is disposed at the side D1, and the extended grounding structure is disposed at the side D2, wherein the ground plane 106 may be, for example, a conductive structure layer in a printed circuit board (PCB). In addition, the symmetrical structure 104, the connection portion 108 and the antenna 102 are implemented by using conductive material(s). The antenna 102 has a feeding end F1, and the feeding end F1 is located on the side D1. The antenna 102 may receive a feeding signal via the feeding end F1 to generate a resonance mode to receive/transmit a RF signal, for example, a RF signal with a frequency less than 2000 MHz. Additionally, the symmetrical structure 104 is symmetric about a symmetry axis C1, and an extension line of the symmetry axis C1 passes through the side D1 and the side D2. For example, in the present embodiment, the symmetrical structure 104 is a bilateral M-symmetrical structure. The symmetrical structure 104 may be electrically connected to the ground plane 106 via the connection portion 108, such that the extended grounding structure is presented in a Y-like shape. In this way, by using the extended grounding structure composed of the symmetrical structure 104 and the connection portion 108 to extend to the ground, the antenna 102 can satisfy the image theory to solve the issue of an insufficient size of the ground plane 106 of the communication device 100 due to a requirement for reducing a product size. As a result, a bandwidth of the antenna 102 may be increased, and antenna efficiency may be improved to significantly enhance communication quality of the communication device 100.

Figure 2:
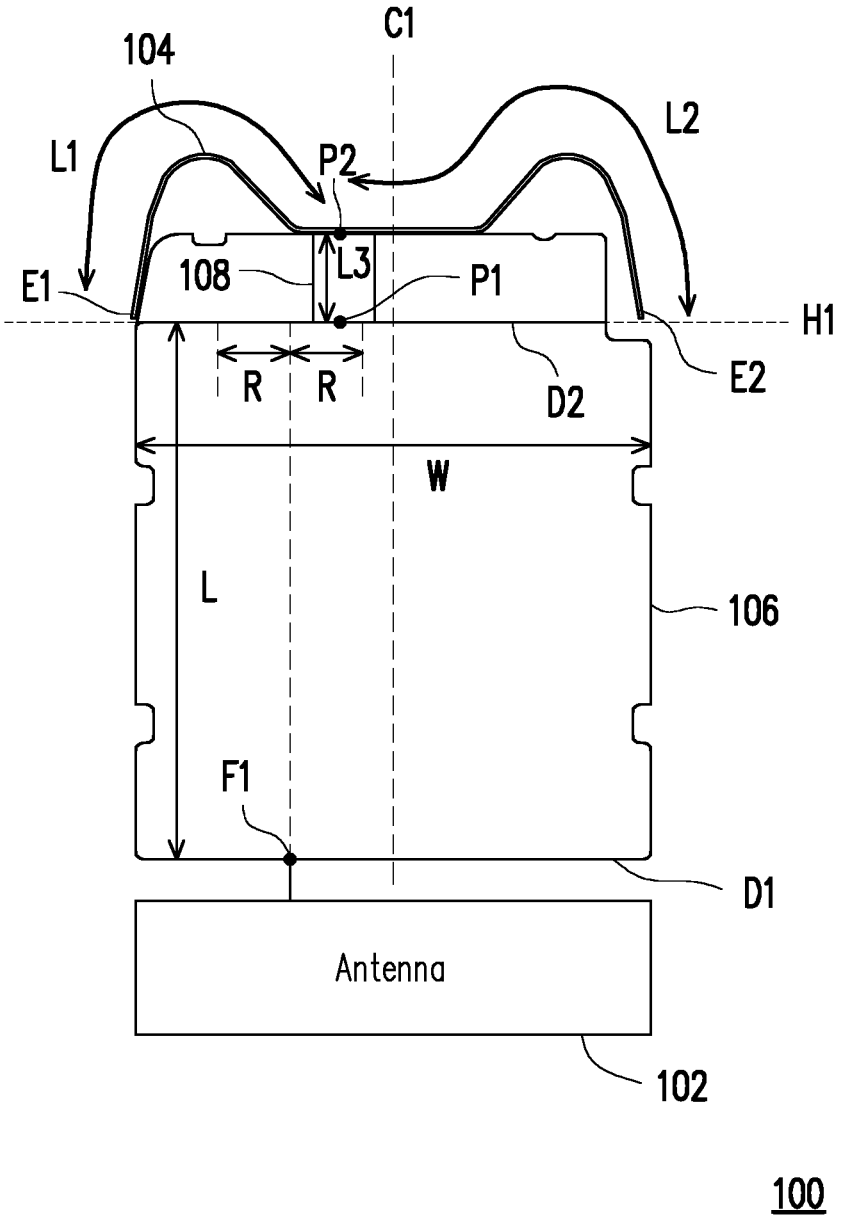
FIG. 2 is a schematic diagram illustrating a communication device according to an embodiment of the disclosure.

Furthermore, details related to the disposition of the antenna 102 and the extended grounding structure (including the symmetrical structure 104 and the connection portion 108) may be as illustrated in FIG. 2. In the present embodiment, the antenna 102 may be, for example, a ¼ wavelength antenna. The ground plane 106 has long sides and short sides, and the side D1 and the side D2 are located on the short sides of the ground plane 106, wherein a length L of the long side of the ground plane 106 is smaller than ⅕ of a wavelength of an operation frequency of the antenna 102, and a length W of the short side of the ground plane 106 is greater than or equal to ⅛ of the wavelength of the operation frequency of the antenna 102.

The symmetrical structure 104 has a first end E1 and a second end E2. A sum of a length from the first end E1 along the symmetrical structure 104 and the connection portion 108 to a connection position P1 of the connection portion 108 and the ground plane 106 and the length L of the long side of the ground plane 106 is within a range of ±10% of ¼ of the wavelength of the operation frequency of the antenna 102. In other words, a sum of lengths of L1, L3 and L (i.e., L1+L3+L) as illustrated in FIG. 2 is within the range of ±10% of ¼ of the wavelength of the antenna 102, wherein the length L1 is a (non-linear) distance from the first end E1 on the symmetrical structure 104 to a connection position P2 of the connection portion 108 and the symmetrical structure 104, and the length L3 is a distance from the connection position P2 of the connection portion 108 and the symmetrical structure 104 to the connection position P1 of the connection portion 108 and the ground plane 106. Similarly, a sum of a length from the second end E2 along the symmetrical structure 104 and the connection portion 108 to the connection position P1 and the length L of the long side of the ground plane 106 is also within a range of ±10% of ¼ of the wavelength of the operation frequency of the antenna 102. In other words, a sum of lengths of L2, L3 and L (i.e., L2+L3+L) as illustrated in FIG. 2 is within the range of ±10% of ¼ of the wavelength of the antenna 102, wherein the length L2 is a (non-linear) distance from the second end E2 on the symmetrical structure 104 to the connection position P2. In this embodiment, the connection position P1 is the middle point of the side of the connection portion 108 that connects to the ground plane 106.

In this way, by setting the length of the extended grounding structure (including the symmetrical structure 104 and the connection portion 108) plus the length of the ground plane 106 to be close or equal to ¼ of the wavelength of the antenna 102, the size of the ground plane 106 may be equivalently increased to optimize impedance matching, such that the antenna 102 can satisfy the image theory to solve the issue of the insufficient size of the ground plane 106.

Figure 3:
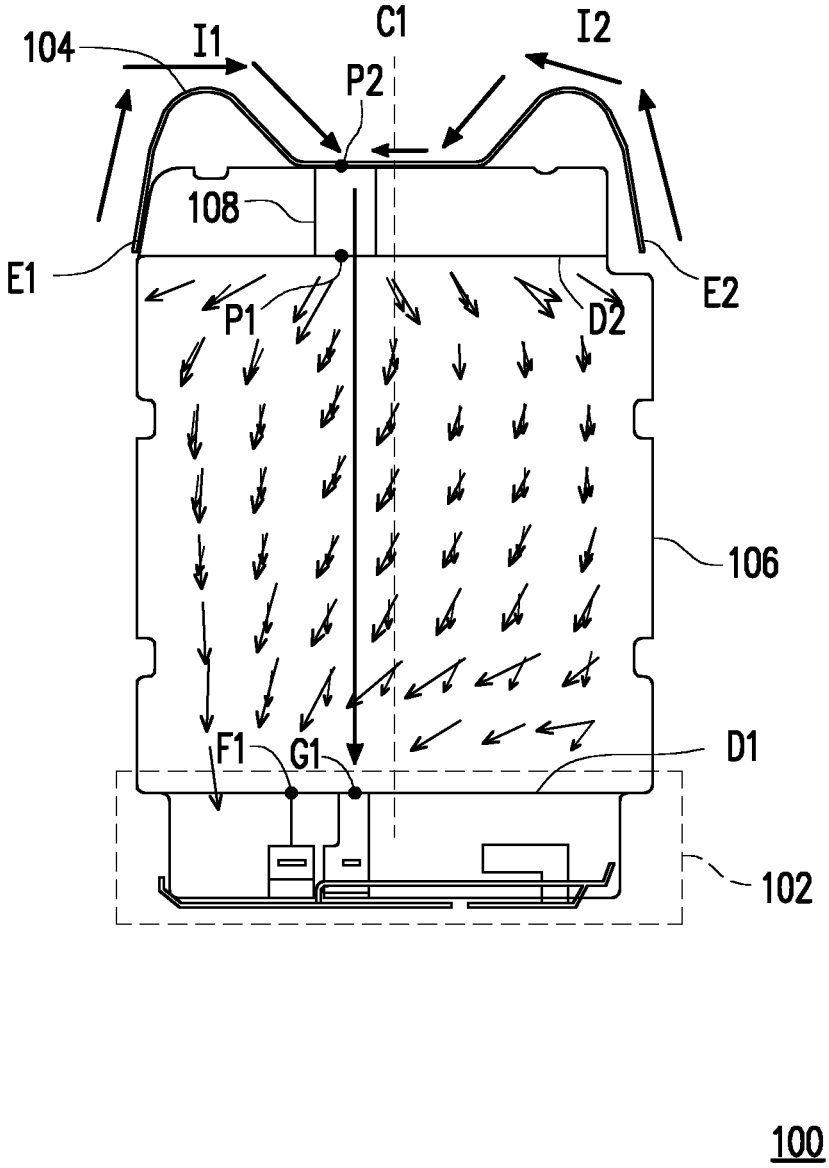
FIG. 3 is a schematic diagram illustrating flow directions of currents of the communication device according to an embodiment of the disclosure.

In addition, a distance from a position of an orthographic projection of the feeding end F1 on the side D2 along the extension direction of the symmetry axis C1 to the connection position P1 of the connection portion 108 and the ground plane 106 is smaller than or equal to a distance R, wherein the distance R is 1/32 of the wavelength of the antenna 102. By setting that distance to be smaller than or equal to 1/32 of the wavelength of the antenna 102, radiation currents I1 and I2 (as illustrated in FIG. 3) generated on the symmetrical structure 104 are evenly distributed on the extended grounding structure. The radiation current I1 flows from the first end E1 to the connecting portion 108, and the radiation current I2 flows from the second end E2 to the connecting portion 108, such that the connection portion 108 has the maximum current. In addition, a current (as shown by the arrows in FIG. 3) generated on the ground plane flows from a side of the extended grounding structure to a side of the antenna 102.

It should be noted that in the present embodiment, a distance between the connection portion 108 and the symmetry axis C1 is smaller than a distance between the connection portion 108 and the first end E1, but the disclosure is not limited thereto. In part of the embodiments, the connection portion 108 may also be adjacent to a side of the first end E1. In addition, a plane where the side D2 is located and is vertical to the ground plane 106 does not intersect the symmetrical structure 104. In other words, the symmetrical structure 104 and the ground plane 106 are located at different sides of the side D2. In FIG. 2, with a reference line H1 as a boundary, the symmetrical structure 104 has to be disposed at a side opposite to the ground plane 106, and the symmetrical structure 104 cannot intersect the reference line H1. For example, the first end E1 and the second end E2 cannot be lower than the reference line H1. Thereby, the efficiency of the antenna 102 may be prevented from being poor due the generation of the radiation currents I1 and I2 on the symmetrical structure 104 being affected by a coupling effect between the symmetrical structure 104 and the ground plane 106. In the embodiment illustrated in FIG. 3, the antenna 102 is implemented by a planar inverted-F antenna (PIFA), and a grounding component of the antenna 102 is connected to the ground plane 106 through a ground point G1, but the disclosure is not limited thereto. The antenna 102 may also be implemented by other types of ¼ wavelength antennas.

Figure 4:
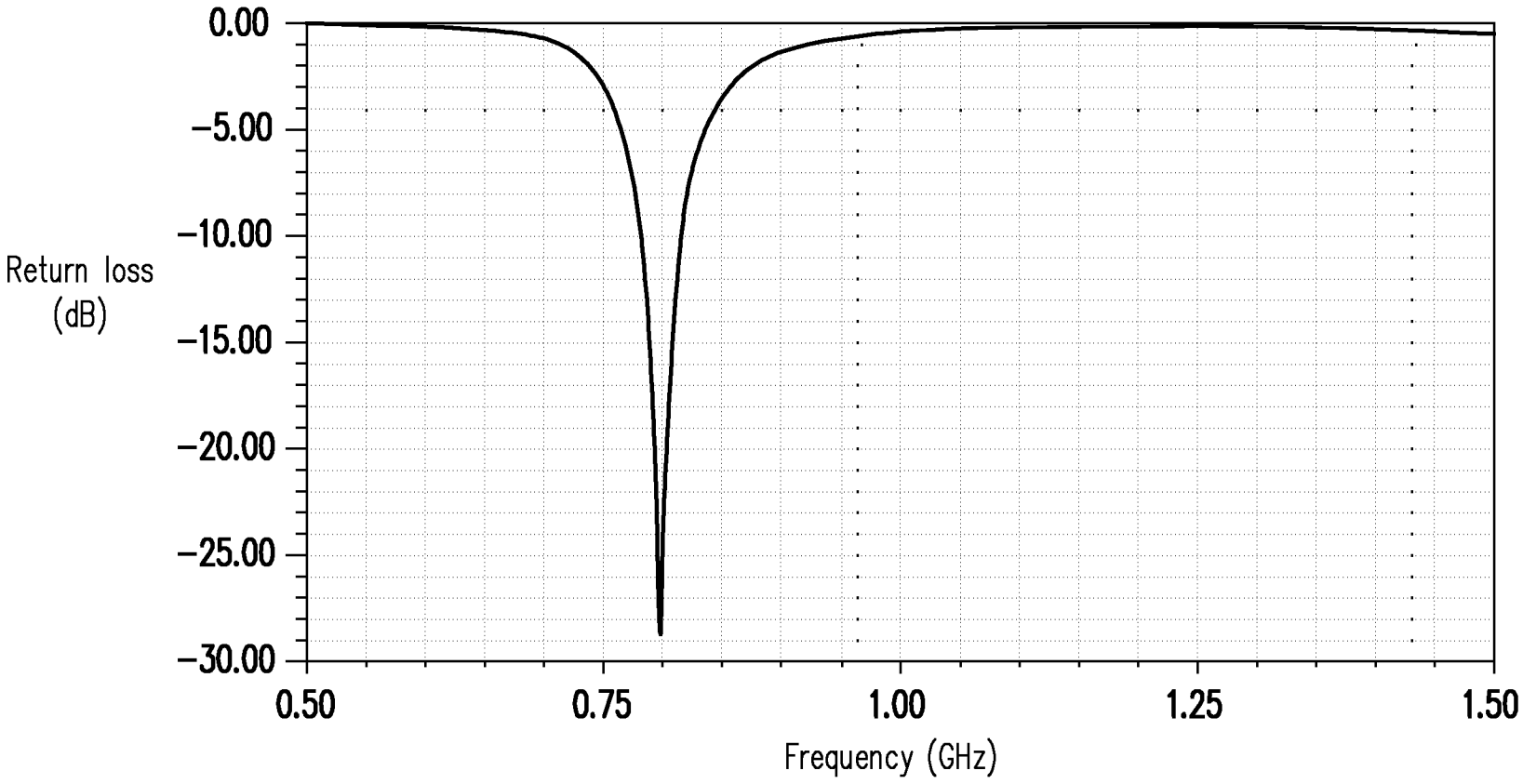
FIG. 4 is a return loss diagram of the antenna according to an embodiment of the disclosure.

In this way, with the extended grounding structure, the size of the ground plane 106 may be equivalently increased, and the extended grounding structure is adaptively disposed corresponding to the feeding end F1 of the antenna 102, such that the extended grounding structure generates the in-phase radiation currents I1 and I2 to increase the bandwidth of the antenna 102, improve the antenna efficiency and significantly enhance communication quality of the communication device 100. As illustrated in FIG. 4 which schematically illustrates the return loss of the antenna 102, the size of the ground plane illustrated in FIG. 3 is about 60 mm×59 mm, and the operation frequency of the antenna 102 is about 800 MHz. After the antenna efficiency is improved, the bandwidth of the antenna 102 in a condition where the return loss is equal to −10 dB may be up to 35 MHz, the efficiency at 800 MHz may reach 40%. In comparison with a scenario that the extended grounding structure is not disposed, the bandwidth of the antenna 102 is increased by 17 MHz, and the antenna efficiency is increased by 10%.

Figure 5:
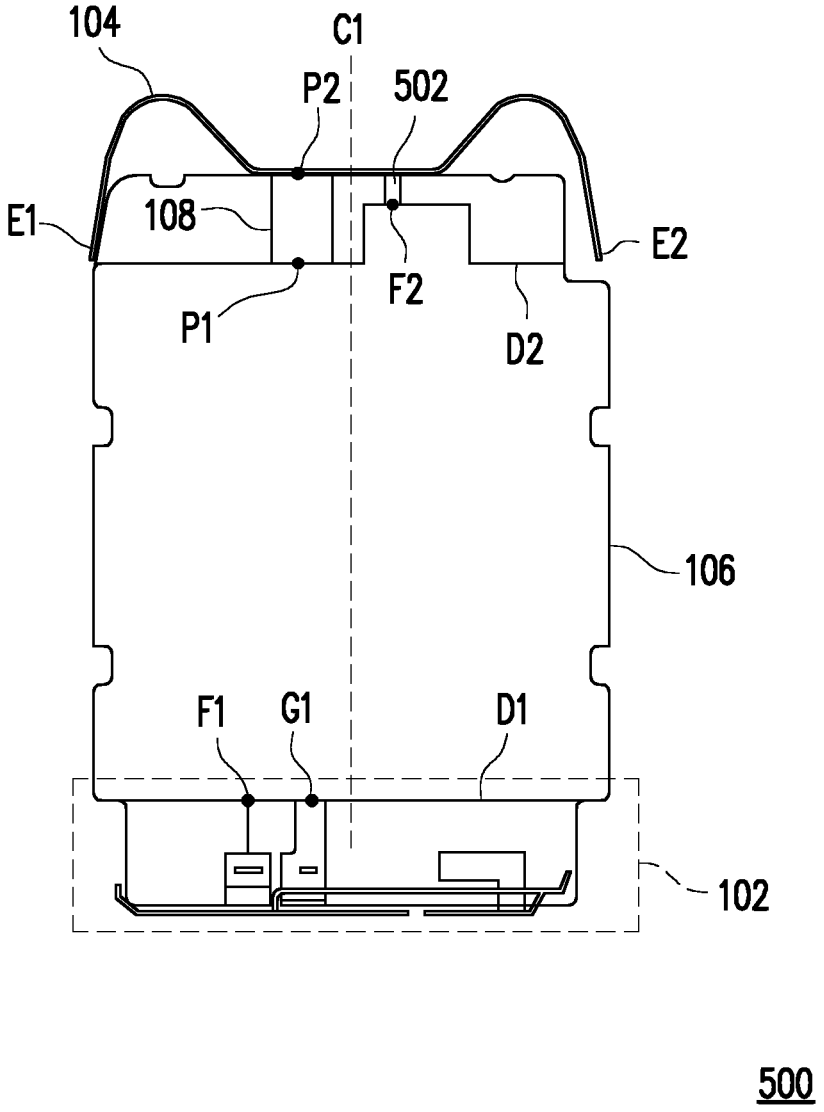
FIG. 5 is a schematic diagram illustrating a communication device according to an embodiment of the disclosure.
Figure 6:
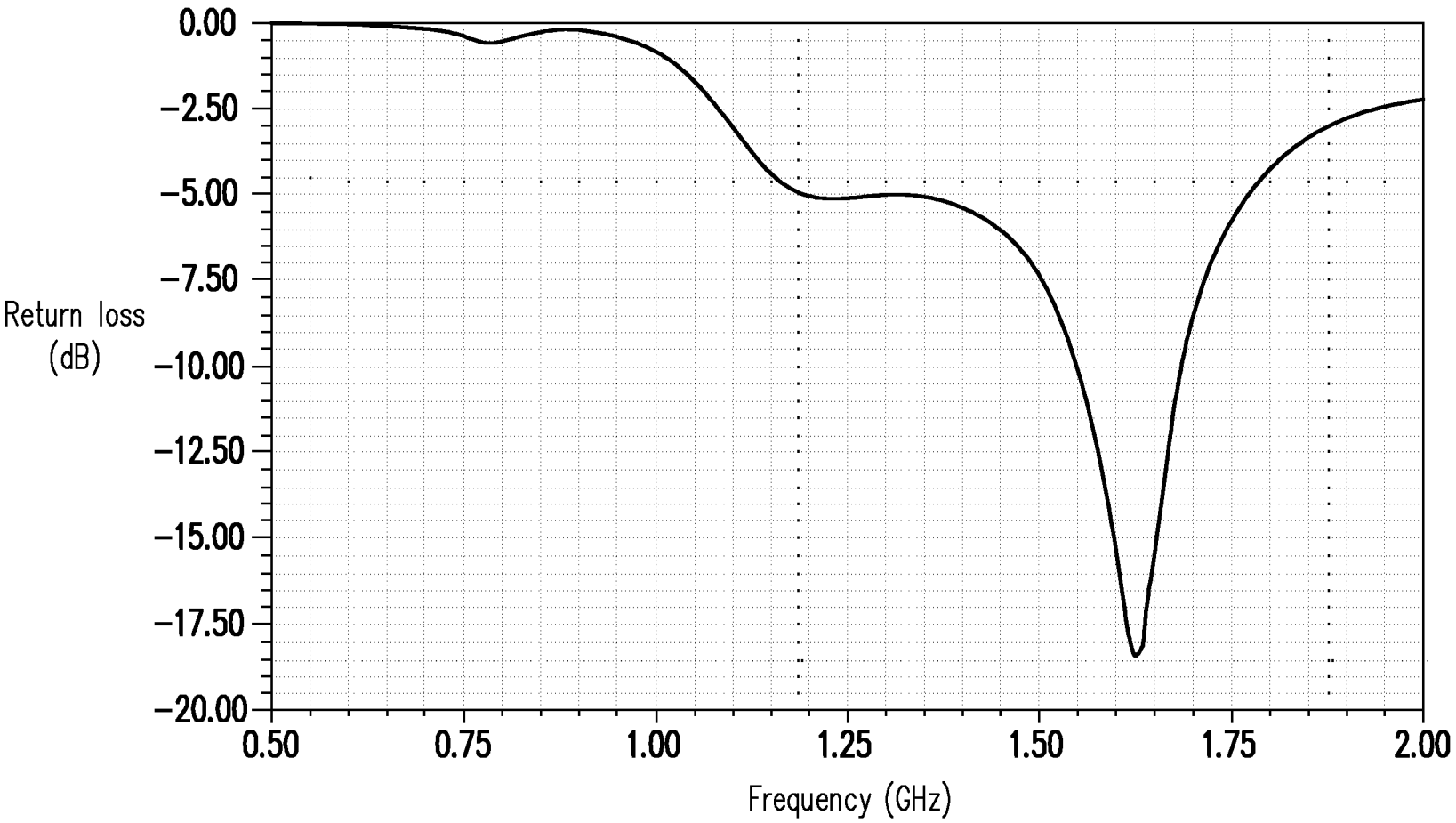
FIG. 6 is a return loss diagram of the extended grounding structure employed as the antenna according to an embodiment of the disclosure.

FIG. 5 is a schematic diagram illustrating a communication device according to an embodiment of the disclosure. In the present embodiment, a communication device 500 may further include a feeding portion 502, an end of the feeding portion 502 is connected to the symmetrical structure 104, and the other end has a feeding end F2. The feeding end F2 may receive a feeding signal to induce the extended grounding structure to generate a resonance mode to receive/transmit a radio frequency signal. In the present embodiment, an antenna formed by the symmetrical structure 104, the connection portion 108 and the feeding portion 502 may be employed as a global navigation satellite system (GNSS) antenna. As illustrated in FIG. 6, an operation frequency of the antenna formed by the symmetrical structure 104, the connection portion 108 and the feeding portion 502 is about 1625 MHz, and a bandwidth thereof in a condition where the return loss is equal to −10 dB is about 136 MHz. In this way, the extended grounding structure not only extends ground but also serve as an antenna, utilizing the internal space of the communication device more effectively.

Figure 7:
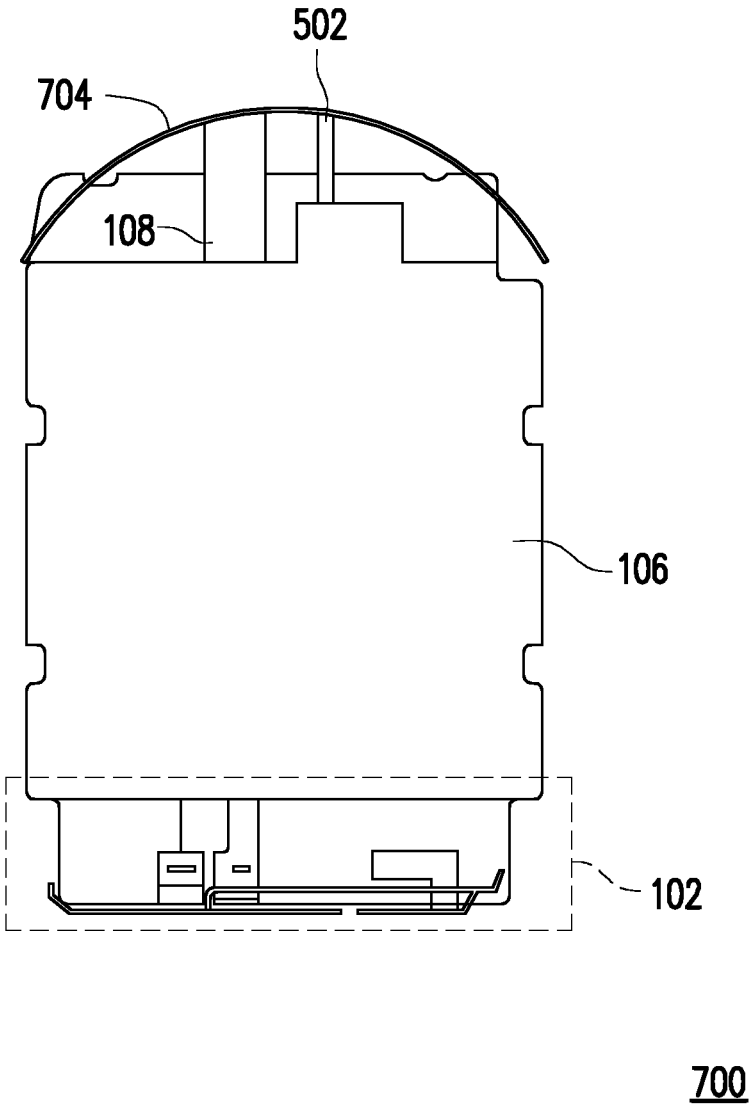
FIG. 7 is a schematic diagram illustrating a communication device according to an embodiment of the disclosure.
Figure 8:
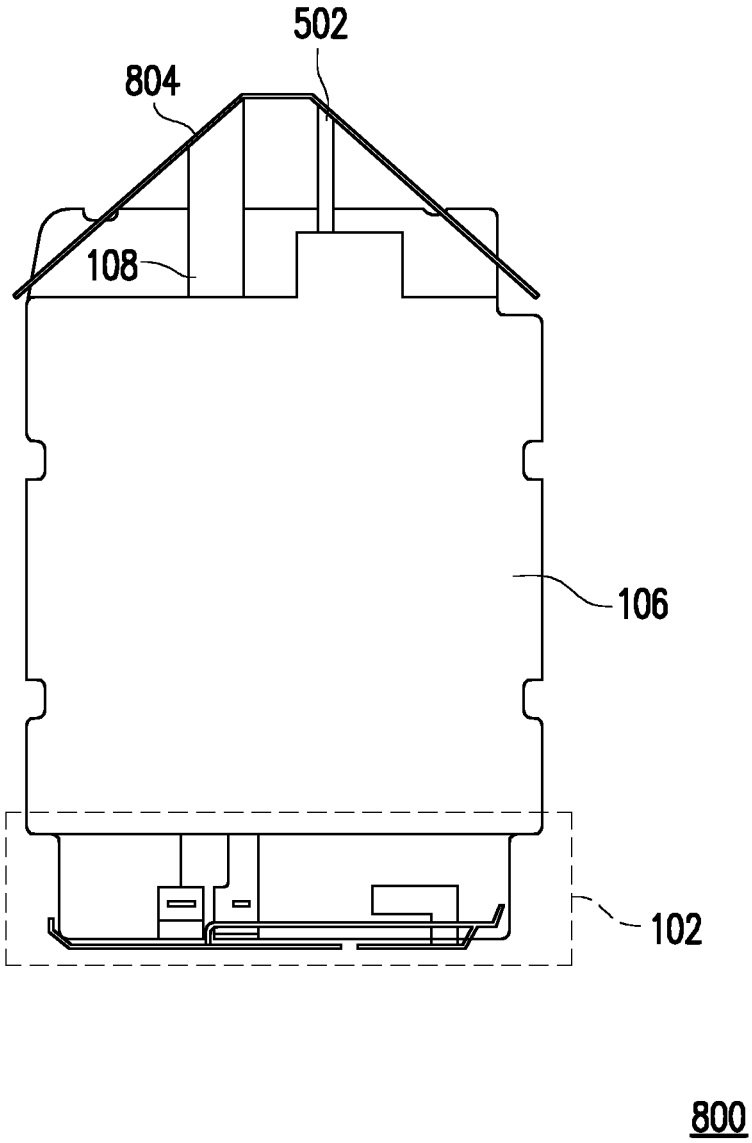
FIG. 8 is a schematic diagram illustrating a communication device according to an embodiment of the disclosure.
Figure 9:
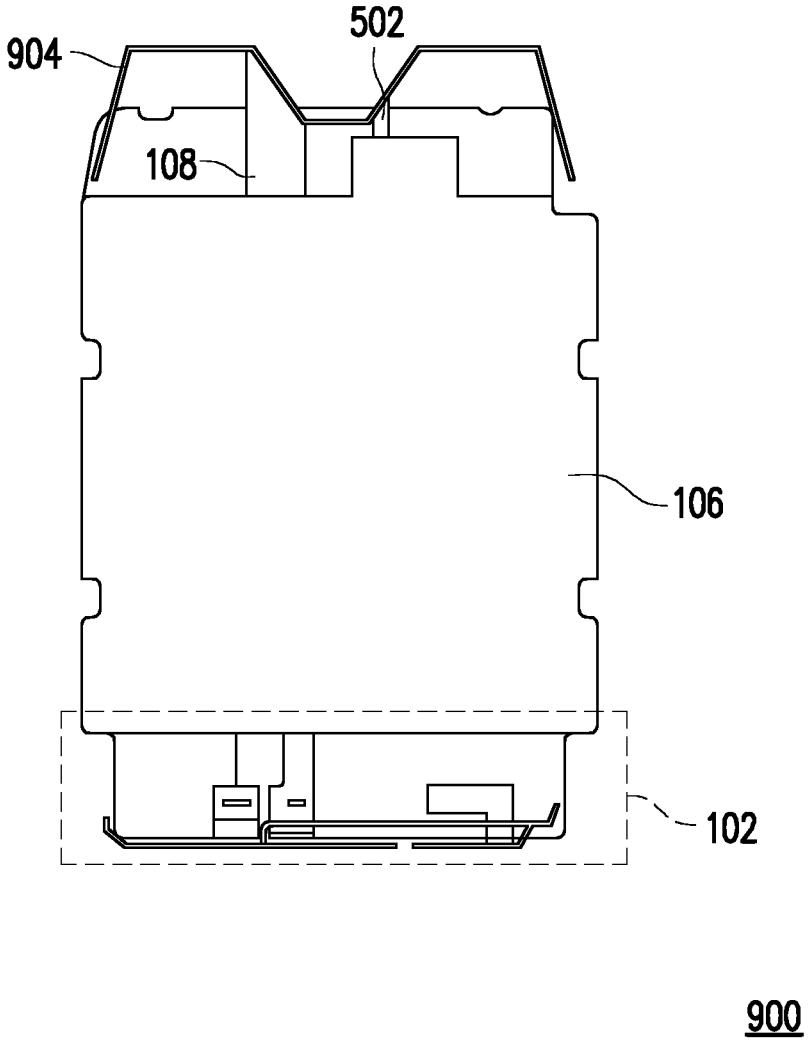
FIG. 9 is a schematic diagram illustrating a communication device according to an embodiment of the disclosure.

It should be noted that although the extended grounding structure having the M-symmetrical structure is used for description in the embodiments above, in part of the embodiments, the symmetrical structure 104 may also have different shapes. For example, in the embodiment illustrated in FIG. 7, a symmetrical structure 704 of a communication device 700 is a U-symmetrical structure. In the embodiment illustrated in FIG. 8, a symmetrical structure 804 of a communication device 800 is a V-symmetrical structure. In the embodiment illustrated in FIG. 9, a symmetrical structure 904 of a communication device 900 is another M-symmetrical structure. The shape of the symmetrical structure is not limited to the shapes numerated in the embodiments mentioned above.

In light of the foregoing, by disposing the extended grounding structure having the symmetrical structure and the antenna respectively at two opposite sides of the ground plane, the extended grounding structure improves the antenna matching characteristics, increases the bandwidth and prevent the antenna efficiency from being poor due to the insufficient size of the ground plane, so as to significantly enhance communication quality of the communication device. In part of the embodiments, the extended grounding structure can, through receiving the feeding signal via the feeding portion, be employed to extend to the ground and serve as an antenna at the same time, so as to enhance the antenna efficiency while increasing the usage efficiency of the internal space of the communication device.

What is claimed is:

1. A communication device, comprising:

a ground plane, having a first side and a second side opposite to each other;

an antenna, disposed at the first side and has a first feeding end; and an extended grounding structure, disposed at the second side and comprising:

a connection portion; and a symmetrical structure, electrically connected to the ground plane via the connection portion, wherein the symmetrical structure is symmetric about a symmetry axis, and an extension line of the symmetry axis passes through the symmetrical structure, the first side and the second side, wherein a plane where the second side is located and is vertical to the ground plane and always does not intersect the symmetrical structure, and a normal line of the plane is parallel with the symmetry axis, and the second side and the plane are coplanar.

2. The communication device according to claim 1, wherein the first feeding end is located on the first side, and a distance between a position of an orthographic projection of the first feeding end on the second side along the extension direction of the symmetry axis and a connection position of the connection portion and the ground plane is smaller than or equal to 1/32 of the wavelength of an operation frequency of the antenna.

3. The communication device according to claim 1, wherein the ground plane has long sides and short sides, the first side and the second side are the short sides.

4. The communication device according to claim 3, wherein a length of the long side of the ground plane is smaller than 1/5 of a wavelength of an operation frequency of the antenna, and a length of the short side of the ground plane is greater than or equal to 1/8 of the wavelength of the operation frequency of the antenna.

5. The communication device according to claim 3, wherein the symmetrical structure has a first end and a second end, and a sum of a length from the first end or the second end along the symmetrical structure and the connection portion to a connection position of the connection portion and the ground plane and the length of the long side of the ground plane is within a range of ±10% of 1/4 of the wavelength of the operation frequency of the antenna.

6. The communication device according to claim 4, wherein the symmetrical structure has a first end and a second end, and a sum of a length from the first end or the second end along the symmetrical structure and the connection portion to a connection position of the connection portion and the ground plane and the length of the long side of the ground plane is within a range of ±10% of 1/4 of the wavelength of the operation frequency of the antenna.

7. The communication device according to claim 1, wherein the antenna comprises a 1/4 wavelength antenna.

8. The communication device according to claim 1, wherein the communication device further comprises:

a feeding portion, having an end connected to the symmetrical structure and the other end having a second feeding end, wherein the second feeding end is located on the second side and serves as a feeding end of a second antenna formed by the extended grounding structure and the feeding portion.

9. The communication device according to claim 1, wherein the symmetrical structure has a first end and a second end, and a first radiation current flowing from the first end to the connecting portion and a second radiation current flowing from the second end to the connecting portion are generated on the symmetrical structure when the antenna functions.

10. The communication device according to claim 1, wherein the symmetrical structure comprises a U-symmetrical structure, a V-symmetrical structure or an M-symmetrical structure.

11. The communication device according to claim 1, wherein the symmetrical structure is not rectangular.

* * * * *